United States Patent [19]

Patry

[11] 3,977,137

[45] Aug. 31, 1976

[54] ROOF VENT SUPPORT ARRANGEMENT

[75] Inventor: Francis Joseph Patry, Lewiston, Maine

[73] Assignee: Johns-Manville Corporation, Denver, Colo.

[22] Filed: June 30, 1975

[21] Appl. No.: 591,784

[52] U.S. Cl. ..... 52/60; 52/58; 52/199; 52/219; 285/42

[51] Int. Cl.[2] ..... I04D 13/14

[58] Field of Search ..... 52/58, 60, 219, 218, 52/199; 285/42, 43, 44

[56] References Cited

UNITED STATES PATENTS

| | | | |
|---|---|---|---|
| 558,025 | 4/1896 | Barry | 52/58 |
| 1,158,117 | 10/1915 | Carrier | 285/43 |
| 1,195,338 | 8/1916 | Churchill | 285/14 |
| 1,210,217 | 12/1916 | Schodde | 285/42 |
| 1,282,535 | 10/1918 | Bropson | 285/44 |
| 3,797,181 | 3/1974 | Nievelt | 52/219 |

FOREIGN PATENTS OR APPLICATIONS

| | | | |
|---|---|---|---|
| 30,993 | 1/1960 | Finland | 52/219 |
| 612,511 | 11/1948 | United Kingdom | 52/58 |

*Primary Examiner*—Ernest R. Purser
*Assistant Examiner*—Henry Raduazo
*Attorney, Agent, or Firm*—R. M. Krone; J. J. Kelly; J. W. McClain

[57] ABSTRACT

A roof vent support arrangement for use in a roof structure including a roof deck and a built-up roof thereon and provided for supporting a vent pipe extending beyond the roof structure through an opening therein is disclosed herein. This arrangement includes a roof deck connector connected to the top surface of the roof deck directly over the vent opening in the deck and around the vent and a vertically adjustable tubular vent connector positioned over the built-up roof and around both the deck connector and vent. The arrangement also includes resilient members fixedly connected with the vent connector for allowing the deck connector to be readily inserted therein and, once inserted, for preventing its separation from the vent connector.

7 Claims, 2 Drawing Figures

ROOF VENT SUPPORT ARRANGEMENT

BACKGROUND OF THE INVENTION

The present invention relates generally to an arrangement for supporting roofing vents and more particularly to a specific roofing vent support arrangement for use in a built-up roofing structure.

A building which includes a built-up roof will typically include a vent pipe extending through the roof structure including the built-up roof. In the past, vents of this type were typically supported rigidly in place relative to the roof structure. A typical support arrangement used for accomplishing this was one which was pre-designed in accordance with a standard roof structure including a standard built-up roof. One drawback with this type of arrangement is that because it is designed for a roof deck and built-up roof of particular thicknesses it cannot be readily adjusted to compensate for variations in the thickness of the built-up roof. For example, if the built-up roof is thicker than that for which the arrangement is designed, the arrangement may require modification. Another drawback resides in the fact that the vent pipe is rigidly fixed in place at the roof structure. Should the building shift or should the portion of the vent pipe exposed to the outside be subjected to a high wind, the vent pipe could possibly shift relative to the roof structure, possibly producing a leak therebetween.

BRIEF SUMMARY OF THE INVENTION

An object of the present invention is to provide a roof vent support arrangement for use in supporting a roof vent in a built-up roofing system, which arrangement is uncomplicated in design and economically provided.

Another object of the present invention is to provide a roof vent support arrangement which can be readily assembled in the field and which, once assembled, remains reliably in place.

Still another object of the present invention is to provide a roof vent support arrangement which is commpatible with roofing systems of variable thicknesses.

The roof vent support arrangement constructed in accordance with the present invention has several components which are similar to components in applicant's ROOF DRAIN ARRANGEMENT disclosed in copending application Ser. No. 490,648 filed July 22, 1974, and has some similar objectives. However, the roof vent support arrangement disclosed herein is especially suitable for supporting a vent pipe extending through an opening in a roofing structure including a roof deck and a built-up roof thereon. This arrangement includes a vertically extending and vertically adjustable tubular deck connector flanged at its bottom end and a tubular vent connector which preferably includes a flexible section (preferably bellowed) for providing lateral and longitudinal flexibility.

The tubular deck connector is located directly on and extends vertically upwardly from the roof deck concentrically around the vent pipe which passes through the deck and built-up roof. The vent connector, which is also positioned concentrically around the vent outside of the roof structure has a bottom end portion located on and extending vertically upwardly from the top surface of the built-up roof and concentrically surrounds a top portion of the deck connector. This bottom portion of the vent connector is secured to the deck connector by resilient means fixedly connected with the internal surface of the vent connector, preferably integrally formed with the flexible section of the connector, for allowing the top portion of the deck connector to be readily inserted into the vent connector and, once inserted, for providing a secure connection to prevent their separation. A top end portion of the vent connector, preferably the top portion of the flexible section, is held fixed by suitable means to and around a portion of the vent pipe located above the roof structure.

The components just described provide a roof vent support arrangement which can be readily assembled in the field regardless of reasonable variations in thickness of the built-up roof with which the support arrangement is to be associated, without requiring additional components and/or modifications generally. The components described also provide for reasonable relative movement between the vent pipe, the roof structure and the vent support arrangement due, for example, to settling of the building and/or high winds without breaking the seal between the built-up roof and the vent.

DETAILED DESCRIPTION

Figure 1:
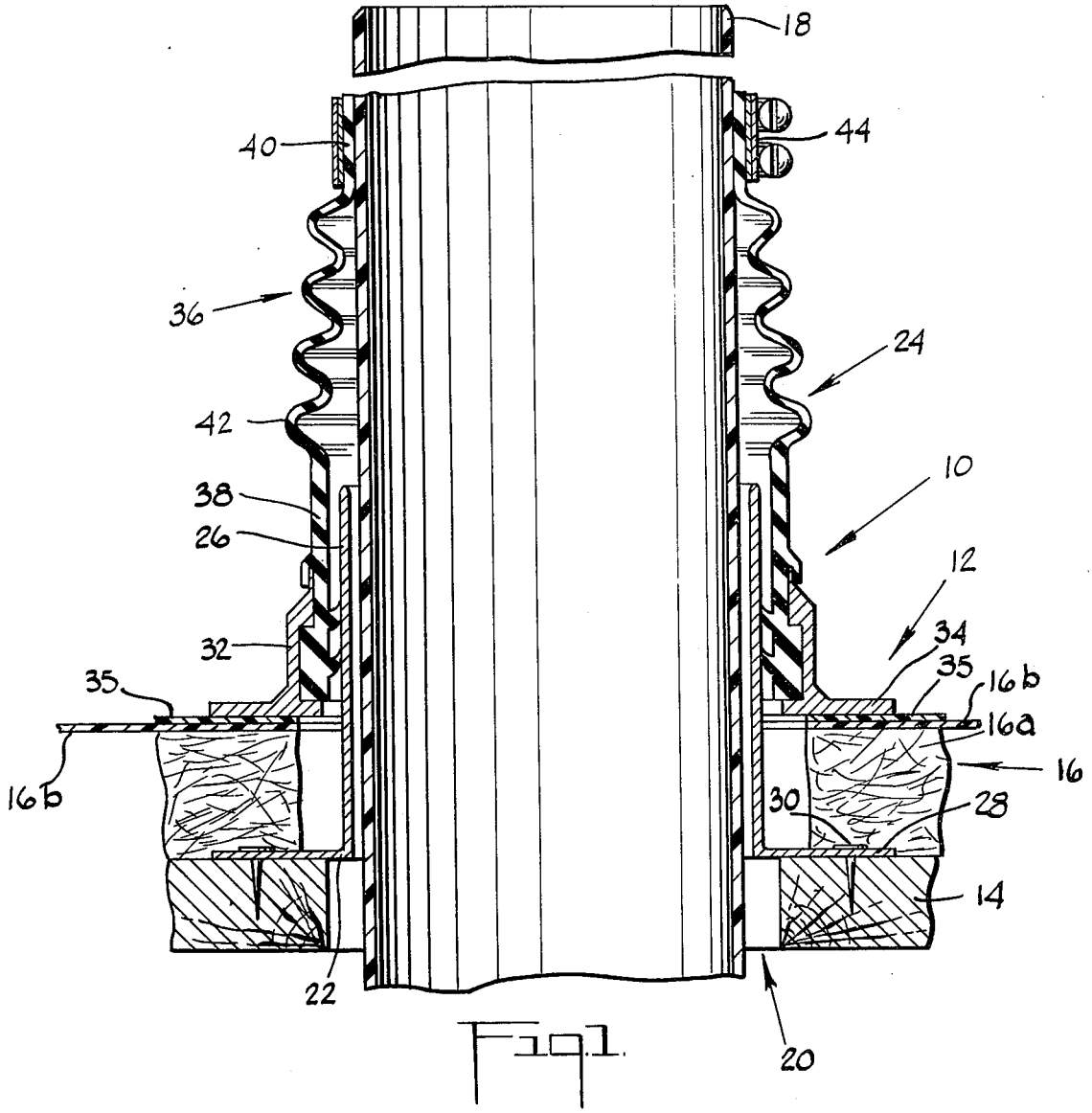
FIG. 1 is a vertical cross-sectional view of a roof vent support arrangement which is constructed in accordance with the present invention and which is shown assembled in a roofing structure including a roofing vent.

Turning now to the drawing, attention is directed to FIG. 1 which illustrates a vent support arrangement which is constructed in accordance with the present invention and which is generally designated by the reference numeral 10. Arrangement 10 is shown assembled in place in a roofing structure generally designated by the reference numeral 12. The roofing structure includes a roof deck 14 and may include a built-up roof 16 comprised of, for example, roof insulation **16*a* and a roof membrane for flashing 16*b* located directly over the deck and/or other components, as is well known. The overall roof structure including the deck and bult-up roof as shown extends horizontally. However, it should be understood that this structure could be sloped. A vent pipe generally designated by the reference numeral 18 extends through the roof structure from the underside of the latter through an opening in the structure, indicated at 20,** and terminates well above the top surface of the structure.

Vent support arrangement 10 includes a roof deck connector 22 and a vent connector 24. As will become more apparent hereinafter, these components cooperate with one another to provide an uncomplicated and economically produced vent support arrangement which can be easily assembled into a new or existing roof structure and which can be readily connected to a new or existing vent extending through the roofing structure, as illustrated in FIG. 1. It will also become more apparent hereinafter that these components, i.e., the deck connector and vent connector, cooperate in a way which allows the arrangement to be assembled in place regardless of reasonable variation in the thickness of the bulit-up roof, without the necessity of additional components or unreasonable modification to either the arrangement or the vent. In addition, the vent support arrangement constructed in accordance with the present invention provides for a reliable seal between the vent and the roofing structure taking into account relative movement of the two due, for example, to settling of the building and/or high winds.

Deck connector 22, as shown in FIG. 1, includes a tubular seciton 26, preferably cylindrical, and a flange 28 extending radially outwardly from and circumscribing the bottom end of the tubular section. Flange 28 is positioned directly on the top surface of deck 14 around opening 20 in the deck and fixedly attached to the deck by suitable means such as screws or nails 30, Tubular section 26 extends vertically upward through opening 20 in the built-up roof and slightly beyond the top surface of the built-up roof. The deck connector may be constructed of a suitable material and is preferably constructed of metal integrally formed to provide tubular section 26 and flange 28.

Vent connector 24 is provided for innerconnecting vent 18 with the roofing structure 12, actually with deck connector 28 and built-up roof 16 in a moisture sealed and vertically adjustable fashion for supporting the vent in place relative to the roofing structure. To accomplish this, the vent connector includes a rigid tubular section 32, preferably cylindrical, having a greater diameter than that of previously discussed section 26, a flange 34 extending radially outwardly from and circumscribing the bottom end of section 32 and a flexible flashing 35, i.e., a sheet of flexible flashing material, for example plastic, adhered to the bottom of flange 34 and extending out beyond the circumference of the flange. As illustrated in FIG. 1, flange 34 with its integral flexible plastic flashing is positioned directly on top of built-up roof 16, actually membrane **16*b* around opening 20 in the built-up roof and is spaced vertically above flange 28 of the deck connector. As will become apparent, the distance between flanges 28, 34 and 35 is not critical so long as a top portion of tubular section 26 extends into tubular section 32 and, hence, a variation in the thickness of the built-up roof is not critical. Flange 28 may remain in place without direct connection to the built-up roof but is preferably fixed to the built-up roof by means of adhesive (not shown). In this regard, it is not desirable to fasten the flange 34 and flashing 35 in place by means of nails, screws, or other such means which puncture the membrane 16*b*. Tubular section 32 extends vertically upward from the built-up roof and, as seen in FIG. 1, circumscribes the top outer surface of tubular section 26. Like deck connector 22, tubular section 32 and flange 34** may be constructed of any suitable materials but are preferably integrally constructed of metal or relatively hard plastic.

Vent connector 24 also includes a second, preferably flexible tubular section 36 which itself includes a bottom portion 38, a top portion 40 and an intermediate portion 42. Bottom portion 38 is positioned concentrically between tubular section 32 and a top portion of tubular section 26 of the deck connector and is fixedly connected to the internal surface of section 32 by suitable means such as, for example, adhesive. Flexible section 36 extends vertically upward so that top portion 40 is located concentrically around vent 18 well above the built-up roof 16. This top portion 40 is held fixed in sealed engagement around and against the vent by suitable means such as, for example, conventional drawband 44.

The intermediate portion 42 of flexible tubular section 36 is preferably bellowed, i.e., includes a plurality of longitudinally adjacent circumferential bellows, as illustrated in FIG. 1. In this regard, the entire flexible tubular section is preferably an integral component constructed of a flexible material such as, for example, an elastomer. By providing bellowed portion 42, the entire flexible tubular section is not only capable of bending laterally but is also capable of stretching lengthwise a substantial distance. This provides several distinct advantages. First, it allows the vent connector to be easily connected to the vent at the desired point over the building structure. In this regard, a variation of the thickness in built-up roof 16 can be readily compensated for by flexible section 36 to provide an appropriate point of connection between vent 18 and vent connector 24. Second, should the building settle or otherwise shift or should a strong wind come up causing a change in alignment between the vent and the building structure, the flexible tubular section will compensate for reasonable changes of this type without placing any substantial stress on the vent support arrangement so as to minimize the possibility of a leakage between the vent and the building structure.

Figure 2:
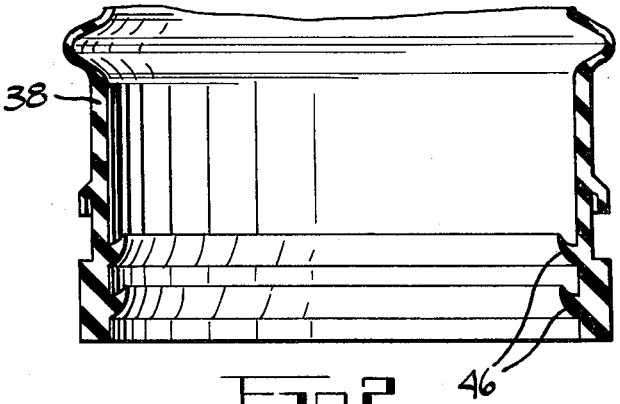
FIG. 2 illustrates a detail in the arrangement of FIG. 1.

As illustrated in FIG. 1, arrangement 10 includes resilient means fixedly connected with the vent connector, specifically the bottom portion 38 of the flexible tubular section for allowing the tubular section 26 of the deck connector to be inserted into the bottom end of the vent connector or, stated conversely, to allow the bottom portion of the vent connector to be positioned over a top portion of tubular section 26 and, once inserted, for preventing the vent connector and deck connector from being readily separated. As seen best in FIG. 2, the means to accomplish this includes a number of resilient gripping elements 46 which preferably comprise an integral part of tubular section 36 and which completely circumscribe the internal surface of the latter, specifically along bottom portion 38. These gripping members are axially spaced from one another and each is thickest at its base, i.e., where it joins the internal surface of the bottom portion 38 and tapers down in thickness towards its free end.

Each circumferential gripping element extends a sufficient distance into bottom portion 38 of the flexible tubular section 36 so that, when the gripping element is in its normal relaxed position, its free end is located within the path taken by tubular section 26 of the deck connector 22 when the latter is inserted into the bottom portion 38 of the flexible section. As section 26 moves into position, as shown In FIG. 1, it engages against the circumferential gripping elements causing the latter to flex upwards, i.e., in the direction of movement of the section 26. This flexing of the gripping element allows the two components, i.e., section 26 of the deck connector and the bottom portion 38 of tubular section 36 to be telescopically positioned together. However, once in the fixed position, the circumferential gripping elements, which are now flexed upwards, prevent the two from readily separating from one another and also provides a moisture seal between. Note that the circumferential gripping elements not only hold flexible tubular section 36 in place around the top portion of tubular section 26, but also hold rigid tubular section 32, flange 34 and flashing 35 in place against the top surface of the built-up roof 16 without absolutely requiring any direct fastening to the built-up roof. It might be desirable and is in fact preferable to adhere, with adhesive for example roofing bitumen, flange 34 to the top surface of the built-up roof, specifically to membrane 16*b*. In this regard, while the gripping elements have been described as completely circumscribing the internal surface of portion 38 of flexible tubular section 36 and while this is preferred so as to form a water-tight seal between the flexible tubular section and deck connector, it is to be understood that they could be discontinuous or of other configurations so long as they allow the deck connector and vent connector to be readily assembled and, once in place, prevent the two from readily separating.

I claim:

1. In a roofing system including a roof deck, a built-up roof thereon and a vent pipe extending through an opening in said deck and built-up roof, a vent support arrangement comprising:

a. a vertically extending tubular deck connector extending upwardly from the top surface of said deck directly over said opening such that said vent extends through said opening and said deck connector and beyond the top thereof, said deck connector including horizontal flange means located at its bottom end fastened to the top surface of said deck;

b. a vertically extending tubular vent connector having a bottom portion located concentrically around the outside of the top end portion of said deck connector, said vent connector including horizontal flange means vertically spaced above said flange means of said deck connector such that said built-up roof is located therebetween;

c. means for connecting a top portion of said vent connector to a portion of said vent located above said deck connector; and d. resilient means fixedly connected with the internal surface of the bottom end portion of said vent connector for allowing the top end portion of said deck connector to be readily inserted within said bottom end portion of said vent connector and, once inserted, for preventing its separation from said vent connector.

2. An arrangement according to claim 1 wherein said vent connector includes a rigid tubular section at its bottom end including said second-mentioned flange means and a tubular section extending above said rigid section and constructed of a flexible material and wherein said resilient means is integrally formed with an internal surface of said flexible tubular section.

3. An arrangement according to claim 2 wherein said resilient means comprises at least one resilient ring concentric with said flexible tubular section and extending into said flexible section, said ring having an axial thickness which decreases in the direction towards the axis of said flexible section.

4. An arrangement according to claim 3 wherein said flexible tubular section includes a longitudinally bellowed section.

5. An arrangement according to claim 1 wherein said flange means of said vertically extending tubular vent connector rests against said built-up roof and is fastened to the built-up roof only by roofing bitumen.

6. An arrangement according to claim 2 wherein said resilient means comprises at least one resilient ring concentric with said deck connector, said ring forming a watertight seal between said deck connector and said vent connector.

7. An arrangement according to claim 1 wherein said vent connector includes a flashing sheet adhered to the underside of the vent connector flange.

* * * * *